US006238130B1

(12) United States Patent
Youngers

(10) Patent No.: US 6,238,130 B1
(45) Date of Patent: May 29, 2001

(54) COUPLING DEVICE FOR A SKID STEER

(75) Inventor: Stephen A. Youngers, Clearwater, KS (US)

(73) Assignee: Case Corporation, Racine, WI (US)

( * ) Notice: Subject to any disclaimer, the term of this patent is extended or adjusted under 35 U.S.C. 154(b) by 0 days.

(21) Appl. No.: 09/232,754

(22) Filed: Jan. 15, 1999

(51) Int. Cl.[7] ..... E02F 3/00

(52) U.S. Cl. ..... 403/322.4; 403/324; 403/325; 414/723; 37/468

(58) Field of Search ..... 403/322.4, 322.3, 403/322.1, 321, 325, 324; 414/723; 37/468

(56) References Cited

U.S. PATENT DOCUMENTS

| | | | |
|---|---|---|---|
| 3,089,261 | 5/1963 | Flath . | |
| 3,220,487 | 11/1965 | Pilch . | |
| 4,167,247 | 9/1979 | Sons et al. . | |
| 4,538,955 | 9/1985 | Langenfeld et al. . | |
| 4,545,720 | 10/1985 | Cochran et al. | 414/723 |
| 4,621,973 | 11/1986 | Langenfeld et al. . | |
| 4,812,103 | 3/1989 | Cochran et al. | 414/723 |
| 4,846,624 | 7/1989 | Hohn . | |
| 4,998,590 | 3/1991 | Wells . | |
| 5,088,881 | 2/1992 | Ball et al. . | |
| 5,098,252 | 3/1992 | Sheesley et al. | 414/723 |
| 5,836,734 | 11/1998 | Doering | 414/723 |

FOREIGN PATENT DOCUMENTS

| | | |
|---|---|---|
| 1369935 | 6/1972 | (GB) . |

OTHER PUBLICATIONS

Case Corporation Service Bulletin, dated Jan. 30, 1996, pp. 1–5.

*Primary Examiner*—Lynne H. Browne
*Assistant Examiner*—John Cottingham
(74) *Attorney, Agent, or Firm*—Jansson, Shupe & Munger LTD

(57) ABSTRACT

A coupling device is provided for interconnecting an attachment tool to the loader arm of the skid steer. The coupling device includes handles which are pivotable between unlocking and locking positions. The handles control coupling pins which diverge from each other and which move between a retracted position and an extended position to capture the attachment tool on the coupling device.

13 Claims, 4 Drawing Sheets

COUPLING DEVICE FOR A SKID STEER

BACKGROUND AND SUMMARY OF THE INVENTION

This invention relates generally to skid steers, and in particular, to a coupling device for interconnecting the loader arms of the skid steer to an attachment tool such as a bucket or the like.

As is known, skid steers are used in wide variety of applications. In order to perform such applications, various types of attachment tools are mounted to the loader arms at the front end of the skid steer. Typically, a coupling device is used to interconnect the loader arms of the skid steer to the attachment tool. It is highly desirable to provide a coupling device which securely interconnects the loader arms of the skid steer to the attachment tool. It is also highly desirable to provide a coupling device which allows a user to quickly and securely substitute one attachment tool for another.

Heretofore, the coupling device was pivotally mounted to the loader arms of the skid steer by pivot pins. Thereafter, the skid steer was interconnected to the attachment tool necessary to perform the task to be undertaken. In order to interconnect the coupling device to the desired attachment tool, the loader arms of the skid steer are such that the coupling device engages mounting shoes extending from the rearward surface of the attachment. The attachment tool is then manipulated in order to align one or more holes on the back thereof with corresponding holes extending through the coupling device. Pins are manually inserted through the coupling device and the attachment tool in order to interconnect the attachment tool to the skid steer.

While manual insertion of pins to interconnect the attachment tool to the skid steer is functional, such manual insertion technique is often difficult and time consuming. The time involved in substituting one attachment tool for another results in significant down time for the skid steer which, in turn, increases the cost of operating the skid steer and reduces the productivity thereof.

In the alternative, the coupling device may include vertical pins which may be inserted into corresponding openings in the attachment tool which are spaced an industry standard distance apart. A complex arrangement of linkages allow a user to insert and remove the vertical pins from their corresponding openings. In addition to the expense associated with providing such linkages, these types of linkages tend to become packed with debris during use of the skid steer rendering them inoperative thereafter.

Therefore, it is a primary object and feature of the present invention to provide a coupling device which securely interconnects an attachment tool to the loader arms of a skid steer.

It is a further object and feature of the present invention to provide a coupling device which quickly and easily interconnects an attachment tool to the loader arms of a skid steer.

It is a still further object and feature of the present invention to provide a coupling device which allows a user to easily interchange a wide variety of attachments on the loader arms of skid steer.

It is a still further object and feature of the present invention to provide a coupling device which is easy to assemble and more durable than prior devices.

In accordance with the present invention, a coupling device is provided for interconnecting an attachment tool to the loader arms of a skid steer. The coupling device includes a frame extending along an axis and mountable on the loader arms of the skid steer. A pivotable handle is mounted to the frame. The handle is moveable between a first unlocking position and a second locking position. A coupling pin extending at an angle to the axis of the frame is connected to the handle and is moveable between a first retracted position and a second extended position in response to movement of the handle between the unlocking position and the locking position.

It is contemplated that the coupling device further include a support bracket interconnected to the frame for supporting an upper portion of the attachment tool. A second support bracket is laterally spaced from the first support bracket and also supports an upper portion of the attachment tool.

A pivotable, second handle may also be mounted to the frame. The second handle is moveable between the first unlocking position and a second locking position. A second coupling pin extending at an angle to the axis of the frame is connected to the second handle and is moveable between a first retracted position and a second extended position in response to movement of the second handle between the unlocking and locking positions. It is contemplated that the first and second coupling pins diverge from each other at a predetermined angle. In order to prevent debris and the like from hampering movement of the coupling pins, shrouds are provided to partially surround corresponding coupling pins.

The frame of the coupling device may include first and second connection elements which define a loader arm receipt cavity. The loader arm receipt cavity is dimensioned to receive an end of a corresponding loader arm. A connection pin extends through the connection elements and the end of the corresponding loader arm to pivotally interconnect the frame of the coupling device to the corresponding loader arm.

In accordance with a still further aspect of the present invention, a coupling device is provided for interconnecting a loader arm of a skid steer to an attachment tool having a mounting bracket and a mounting plate with an aperture therethrough. The coupling device includes a frame extending along an axis which is pivotally connected to the end of the loader arm. The frame has upper and lower opposite sides. A support bracket is mounted to the upper side of the frame for engaging and supporting the mounting bracket of the attachment tool. A coupling pin is slidably supported by the frame at an angle to the axis of the frame and has a coupling end. The pin is moveable between a first extended position wherein the coupling of the pin extends through the aperture in the mounting plate of the attachment tool and a second retracted position. A handle controls movement of the coupling pin between the extended and retracted positions. A locking structure is provided for maintaining the coupling pin in the extended position. It is contemplated that the coupling pin be tapered in order to compensate for variations in the size and location of the pin-receiving aperture in the mounting plate of the attachment tool. In addition, a shroud may be interconnected to the frame in order to partially surround the coupling pin and prevent debris or the like from hindering movement thereof.

It is further contemplated that the support bracket be generally L-shaped and include a resilient engagement element for engaging the mounting bracket of the attachment tool.

The frame may include first and second connection elements which define a loader arm receipt cavity in the frame. The loader arm receipt cavity is adapted for receiving an end of a corresponding loader arm. A connection pin extends through the connection elements and the end of the corresponding loader arms to pivotally interconnect the frame to the corresponding loader arm.

BRIEF DESCRIPTION OF THE DRAWINGS

The drawings furnished herewith illustrate a preferred construction of the present invention in which the above advantages and features are clearly disclosed, as well as others which will be readily understood from the following description of the illustrated embodiment.

In the drawings

DETAILED DESCRIPTION OF THE PREFERRED EMBODIMENT

Figure 1:
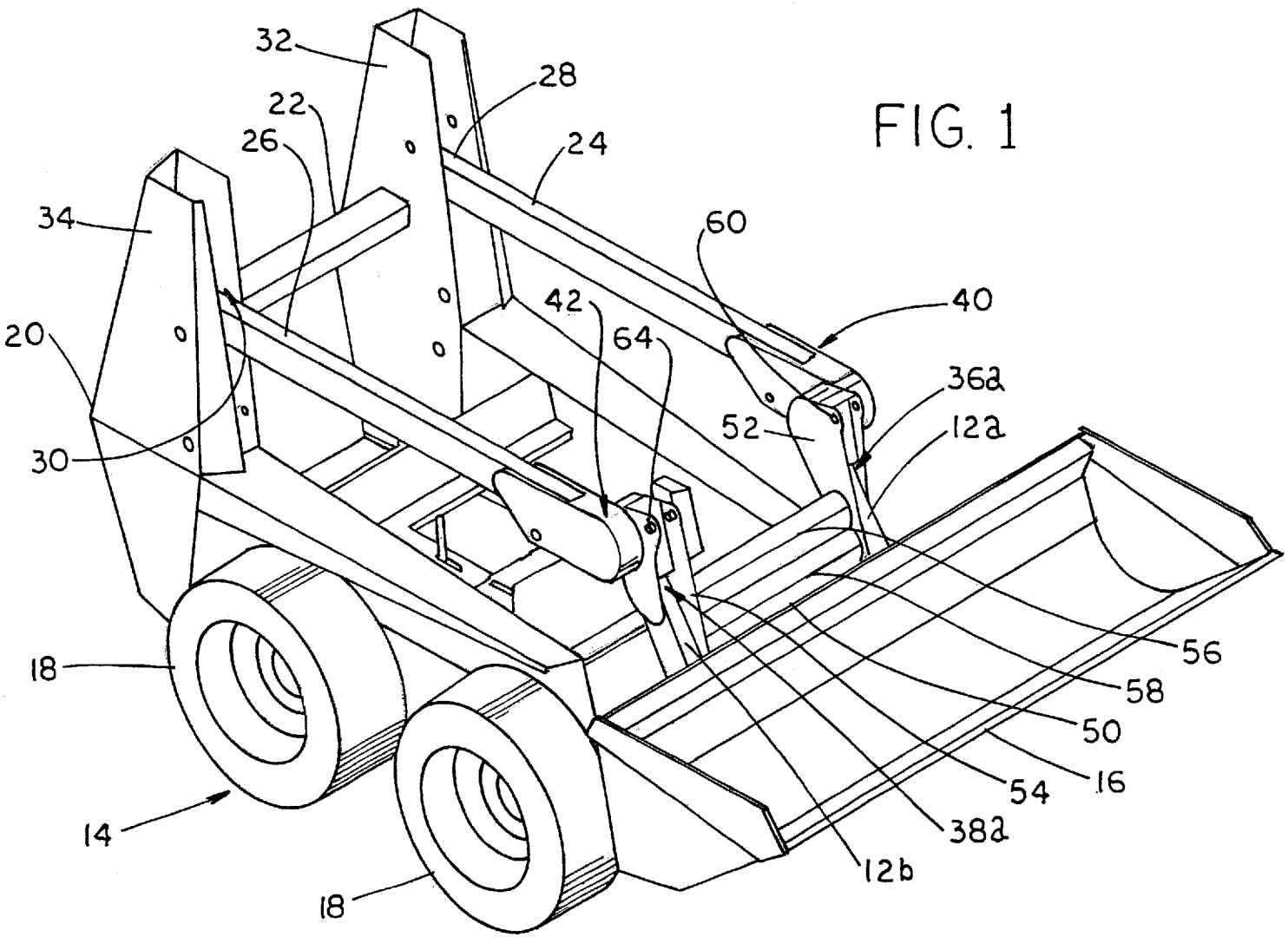
FIG. 1 is an isometric view of a skid steer incorporating the coupling device of the present invention.
Figure 2:
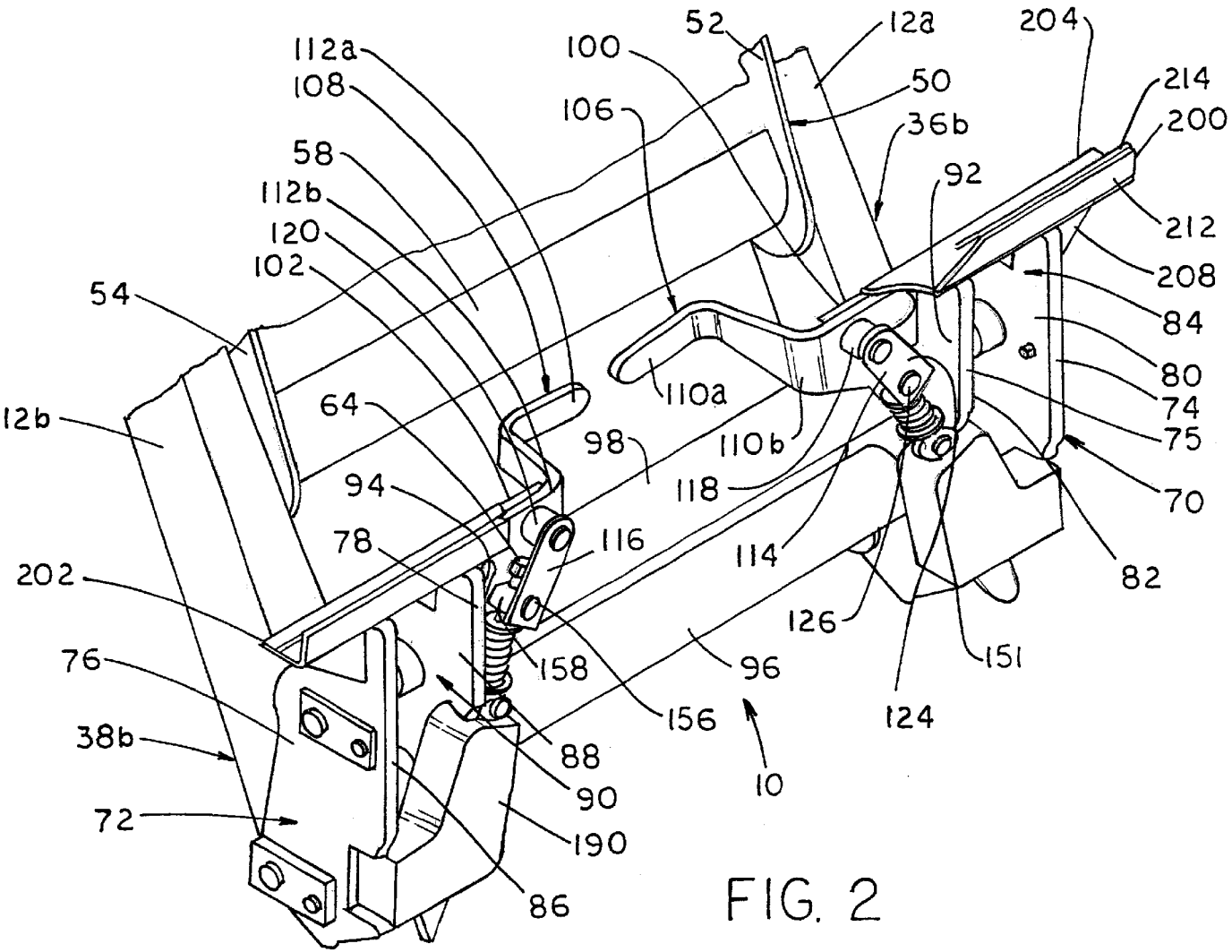
FIG. 2 is an isometric view of the coupling device of the present invention.

Referring to FIG. 2, a coupling device in accordance with the present invention is generally designated by the reference numeral 10. As best seen in FIG. 1, coupling device 10 is intended to interconnect the loader arms 12*a* and 12*b* of a skid steer 14 to an attachment tool such as bucket 16. However, it is contemplated as being within the scope of the present invention that coupling device 10 be used for interconnecting bucket 16 to other types of vehicles, such as front-end loading tractors or the like. Further, it is contemplated as being within the scope of the present invention that coupling device 10 be used to interconnect other types of attachment tools to skid steer 14. As such, bucket 16 is provided only as an example and is not intended to limit the type of attachment tool which may be coupled to skid steer 14 by coupling device 10.

As is conventional, skid steer 14 includes a support frame 20 supported by four independently driven wheels 18. Support frame 20 of skid steer 14 includes a loader assembly 22 on the upper portion thereof. Loader assembly 22 includes left and right support arms 24 and 26, respectively. Support arms 24 and 26 include first ends 28 and 30, respectively, pivotally mounted to corresponding supporting members 32 and 34 of support frame 20. As is conventional, pivotal movement of support arms 24 and 26 is controlled by corresponding hydraulic cylinders (not shown).

Loader assembly 22 further includes corresponding left and right loader arms 12*a* and 12*b*, respectively. Loader arm 12*a* includes a first end 36*a* pivotally mounted to second, terminal end 40 of support arm 24. Similarly, a first end 38*a* of loader arm 12*b* is pivotally mounted to second, terminal end 42 of support arm 26.

In order to provide strength and stability to loader arms 12*a* and 12*b*, loader arms 12*a* and 12*b* are braced by a support assembly 50. Support assembly 50 includes first and second parallel support members 52 and 54, respectively, extending along the length of corresponding loader arms 12*a* and 12*b*, respectively. Support members 52 and 54 are interconnected by first and second cross supports 56 and 58, respectively. A first end of support member 52 is pivotally mounted to terminal end 40 of support arm 24 through pivot point 60 so as to capture end 36*a* of loader arm 12*a* therebetween. Similarly, a first end of support member 54 is pivotally mounted at pivot point 64 to terminal end 42 of support arm 26 so as to capture first end 38*a* of support arm 12*b* therebetween.

Referring FIG. 2, coupling device 10 includes first and second mounting shoes 70 and 72, respectively, dimensioned for receiving the terminal ends 36*b* and 38*b* of loader arms 12*a* and 12*b*, respectively. Mounting shoes 70 and 72 are defined by generally parallel outer plates 74 and 76, respectively, and generally parallel inner plates 75 and 78, respectively.

Inner surface 80 of outer plate 74 and inner surface 82 of inner plate 75 define loader arm receipt cavity 84 therebetween in mounting shoe 70. Similarly, the inner surface 86 of outer plate 76 and the inner surface 88 of inner plate 78 define loader arm receipt cavity 90 therebetween in mounting shoe 72. The outer surface 92 of inner plate 75 of mounting shoe 70 is interconnected to the outer surface 94 of inner plate 78 of mounting shoe 72 by first and second, parallel cross braces 96 and 98, respectively. Cross braces 96 and 98 provide strength and stability to coupling device 10 and prevent lateral movement of mounting shoes 70 and 72.

Outer surfaces 92 and 94 of inner plates 76 and 78, respectively, further include handle support walls 100 and 102, respectively, lying in a common plane and extending toward each other. First and second handles 106 and 108, respectively, are pivotably mounted to corresponding handle support walls 100 and 102, respectively. Handles 106 and 108 include gripping portions 110*a* and 112*a*, respectively, and body portions 110*b* and 112*b*, respectively. Plates 114 and 116 are rigidly mounted to corresponding body portions 110*b* and 112*b*, respectively, of handles 106 and 108, respectively, by mounting elements 118 and 120, respectively. Handles 106 and 108 are pivotally mounted to corresponding handle support walls 100 and 102, respectively, by mounting pins 122, thereby allowing handles 106 and 108 to pivot thereon between a first pin retracted position, FIG. 3, and a second coupling pin extended position, FIG. 4.

Figure 3:
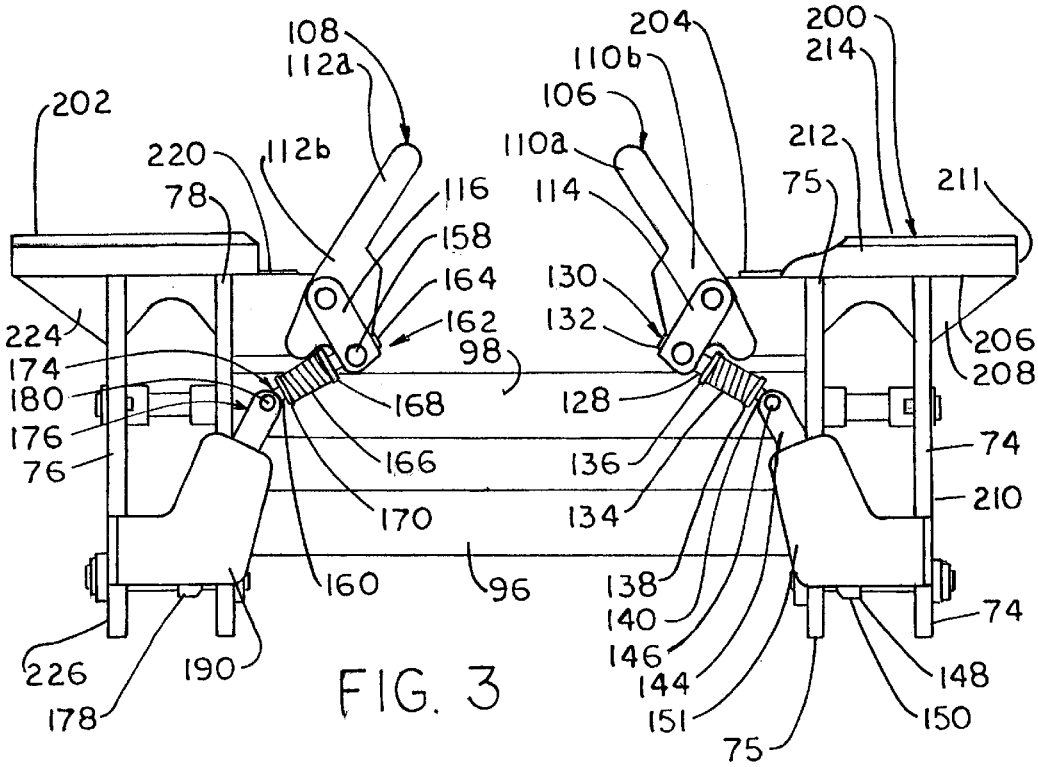
FIG. 3 is a front elevational view of the coupling device of the present invention showing the coupling pins in a retracted position.
Figure 4:
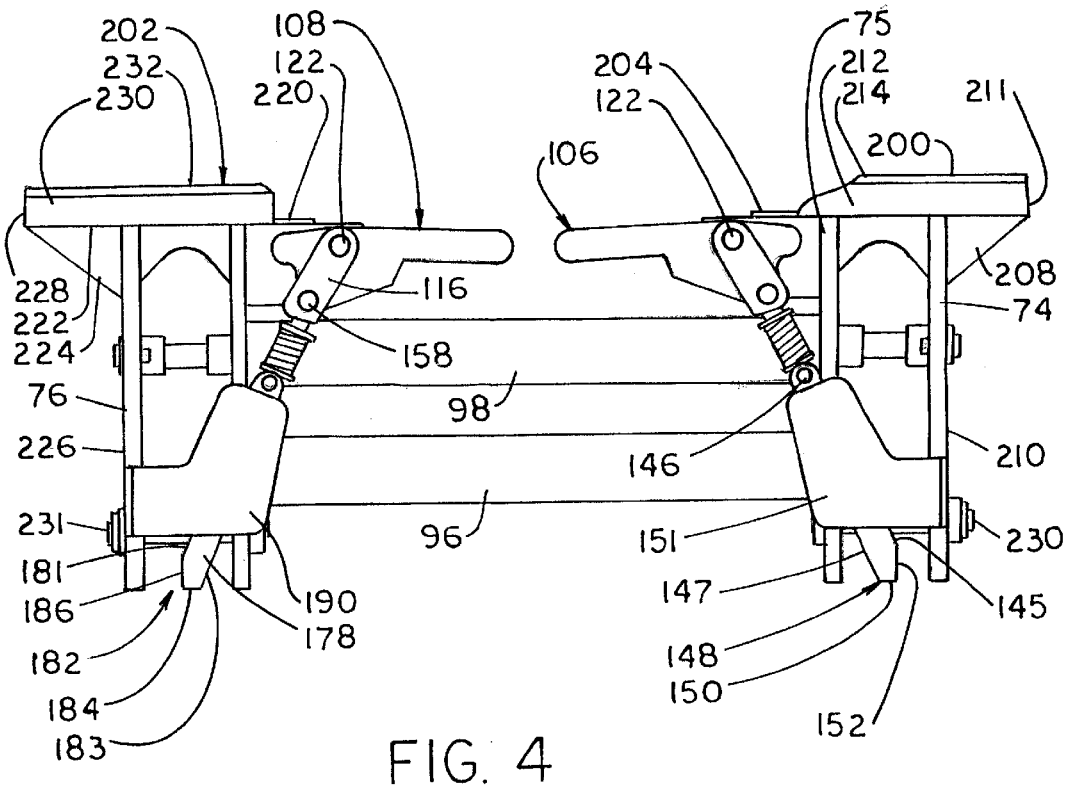
FIG. 4 is a front elevational view, similar to FIG. 3, showing the coupling pins in an extended position.

Plate 114 includes an aperture 124 which is axially aligned with a corresponding aperture (not shown) in the body portion 110*b* of handle 106. Trunnion 126 is pivotably supported and extends through aperture 124 and the aperture in handle 106. Referring to FIGS. 3–4, threaded end 130 of rod 128 extends through a central opening in trunnion 126 and is adapted for receiving a nut 132 thereon. Spring 134 is captured between first and second washers 136 and 138, respectively, which are slidably received on rod 128 Washer 136 abuts trunnion 126 for slidable movement therewith along rod 128. Washer 138 abuts a shoulder in rod 128 to prevent movement of washer 138 away from threaded end 130 along rod 128.

End 140 of rod 128 is pivotally mounted to a first end 142 of coupling pin 144 by pivot pin 146. Coupling pin 144 includes first and second sides 145 and 147 and a second, opposite end 148 which terminates at generally flat end surface 150. A generally tapered surface 152 extends from and interconnects end surface 150 with first side 145. A shroud 151 partially surrounds coupling pin 144 and is secured to outer and inner plates 74 and 75, respectively, of mounting shoe 70 so as to isolate coupling pin 144 from the external environment and to prevent debris or the like from hampering movement of coupling pin 144 in response to the pivoting of handle 106.

Referring to FIG. 3, with handle 106 in the pin retracted position, spring 134 provides a biasing force on trunnion 126 which maintains handle 106 in such position. As handle 106 is pivoted counterclockwise by a user to overcome the biasing force of spring 134, the position of trunnion 126 is translated over center of the pivot point of handle 106 at mounting pin 122 such that the biasing force provided on trunnion 126 by spring 134 urges handle 106 counterclockwise. Referring to FIG. 4, with handle 106 in the pin extended position, spring 134 provides a biasing force on trunnion 126 such that handle 106 is maintained in such position.

Likewise, in order to return handle 106 to the pin retracted position, handle 106 is pivoted clockwise by a user to overcome the biasing force of the spring 134. As handle 106 is pivoted on its pivot point at mounting pin 122, the position of trunnion 126 is translated over the center of the pivot point such that the biasing force provided on trunnion 126 by spring 134 urges handle 106 clockwise. As previously described, with handle 106 in the pin retracted position, spring 134 provides a biasing force on trunnion 126 which maintains handle 106 in such position.

Similarly, plate 116 of handle 108 includes an aperture 156 which is axially aligned with a corresponding aperture (not shown) in handle 108. Trunnion 158 is pivotably supported by extends through aperture 156 and the aperture in handle 108. Threaded end 162 of rod 160 extends through a central opening in trunnion 158 and is adapted for receiving a nut 164 thereon. Spring 166 is captured between first and second washers 168 and 170, respectively, which are slidably received on rod 162. Washer 168 abuts trunnion 158 and is urged thereagainst by the biasing force of spring 134. Washer 170 abuts shoulder 172 in rod 162 to prevent movement of washer 170 away from threaded end 130 along rod 162.

End 174 of rod 160 is pivotally mounted to a first end 176 of coupling pin 178 by pivot pin 180. Coupling pin 178 includes first and second sides 181 and 183 and a second, opposite end 182 which terminates at an end surface 184. A generally tapered surface 186 extends from and interconnects end surface 184 with first side 181 of coupling pin 178.

As best seen in FIGS. 3 and 4, coupling pins 144 and 178 diverge from each other at a predetermined angle. As heretofore described, by providing each coupling pin 144 and 178 at a predetermined angle to vertical, the complexity of the linkage needed to move the coupling pins 144 and 178 between the retracted position, FIG. 3, and the extended position, FIG. 4, is greatly reduced.

End surface 150 of coupling pin 144 and end surface 184 of coupling pin 178 are separated by a predetermined distance corresponding to an industry standard width between pin-receiving apertures provided in various attachment tools such as bucket 16 which are designed for attachment to the loader arms 12*a* and 12*b* of a skid steer 14. Further, tapered surface 152 of coupling pin 144 and tapered surface 186 of coupling pin 178 are provided to compensate for possible variances in the distance between pin-receiving apertures in various attachment tools to be mounted on skid steer 14.

It is also contemplated to provided a taper 144*a* and (not shown) in the forward face of corresponding coupling pins 144 and 178, respectively, to compensate for variances in the size and location of pin-receiving apertures in various attachment tools to be mounted on skid steer 14.

A shroud 190 partially surrounds coupling pin 178 and is secured to the outer and inner plates 76 and 78, respectively, of mounting shoe 72 so as to isolate coupling pin 178 from the external environment and to prevent debris or the like from hampering movement of coupling pin 178 in response to the pivoting of handle 108.

Referring to FIG. 3, with handle 108 in the pin retracted position, spring 166 provides a biasing force on trunnion 158 thereby maintaining handle 108 in such position. As handle 108 is pivoted clockwise by a user to overcome the biasing force of spring 166, the position of trunnion 158 is translated over center of the pivot point of handle 108 and mounting pin 122 such that the biasing force provided on trunnion 158 by spring 166 urges handle 108 clockwise. Referring to FIG. 4, with handle 108 in the pin extended position, spring 166 provides a biasing force on trunnion 158 such that handle 108 is maintained in such position.

In order to return handle 108 to the pin retracted position, handle 108 is pivoted clockwise by a user to overcome the biasing force of the spring 166. As handle 108 is pivoted on its pivot point at mounting pin 122, the position of trunnion 158 is translated over the center of the pivot point such that the biasing force provided trunnion 158 by spring 166 urges handle 108 clockwise. As previously described, with handle 108 in the pin retracted position, spring 166 provides a biasing force on trunnion 156 which maintains handle 108 in such position.

Coupling device 10 further includes first and second upper support brackets 200 and 202, respectively, mounted on corresponding mounting shoes 70 and 72, respectively. Support bracket 200 includes a horizontal base 204 having an underside 206 affixed to the upper edges of plates 74 and 75 of mounting shoe 70. A gusset 208 extends between the outer surface 210 of outer plate 74 and the underside 206 of horizontal base 204 in order to provide added support to support bracket 200. Support bracket 200 further includes a connection bracket 212 which extends from horizontal base 204. Connection bracket 211 includes a leg first 212 which extends vertically from horizontal base 204 and a second leg 214 which extends from first leg 212. First and second legs 212 and 214, respectively, form a resilient connector which dimensioned for receipt in a corresponding connector receipt cavity formed in the rearward surface of bucket 16, as hereinafter described.

Similarly, support bracket 202 includes a horizontal base 220 having an underside 222 affixed to the upper edges of plates 76 and 78 of mounting shoe 72. A gusset 224 extends between the outer surface 226 of outer plate 76 and the underside 222 of horizontal base 220 in order to provide added support to support bracket 200. Support bracket 202 further includes a connection bracket 228 which extends from horizontal base 220. Connection bracket 228 includes a leg first 230 which extends vertically from horizontal base 220 and a second leg 232 which extends from first leg 230. First and second legs 230 and 232, respectively, form a resilient connector which is dimensioned for receipt in a corresponding connector receipt cavity formed in the rearward surface of bucket 16, as hereinafter described.

Mounting shoes 70 and 72 of coupling device 10 are interconnected to the terminal ends 36*b* and 38*b* of corresponding loader arms 12*a* and 12*b*, respectively by pivot pins 230 and 231. Pivot pin 230 extends between outer and inner plates 74 and 75 of mounting shoe 70 and through terminal end 36*b* of loader arm 12*a* so as to pivotally interconnect loader arm 12*a* to coupling device 10. Similarly, pivot pin 231 extends between outer and inner plates 76 and 78 of mounting shoe 70 and through terminal end 38*b* of loader arm 12*b* so as to pivotally interconnect loader arm 12*b* to coupling device 10.

It is contemplated that coupling device 10 be further connected to skid steer 14 by hydraulic cylinders which extend between loader assembly 22 and mounting shoes 70 and 72. Pivot pin 240 may extend between outer inner plates 74 and 75 of mounting shoe 70 so as to capture the terminal end of the shaft of such hydraulic cylinder thereon. Similarly, pivot pin 242 may extend between outer and inner plates 76 and 78 of mounting shoe 72 and so as to capture the terminal end of a shaft of a second of such hydraulic cylinders thereon. As is known, such types of hydraulic cylinders are used to control the pivotable movement of coupling device 10 with respect to loader arms 12*a* and 12*b* of skid steer 14.

Figure 5:
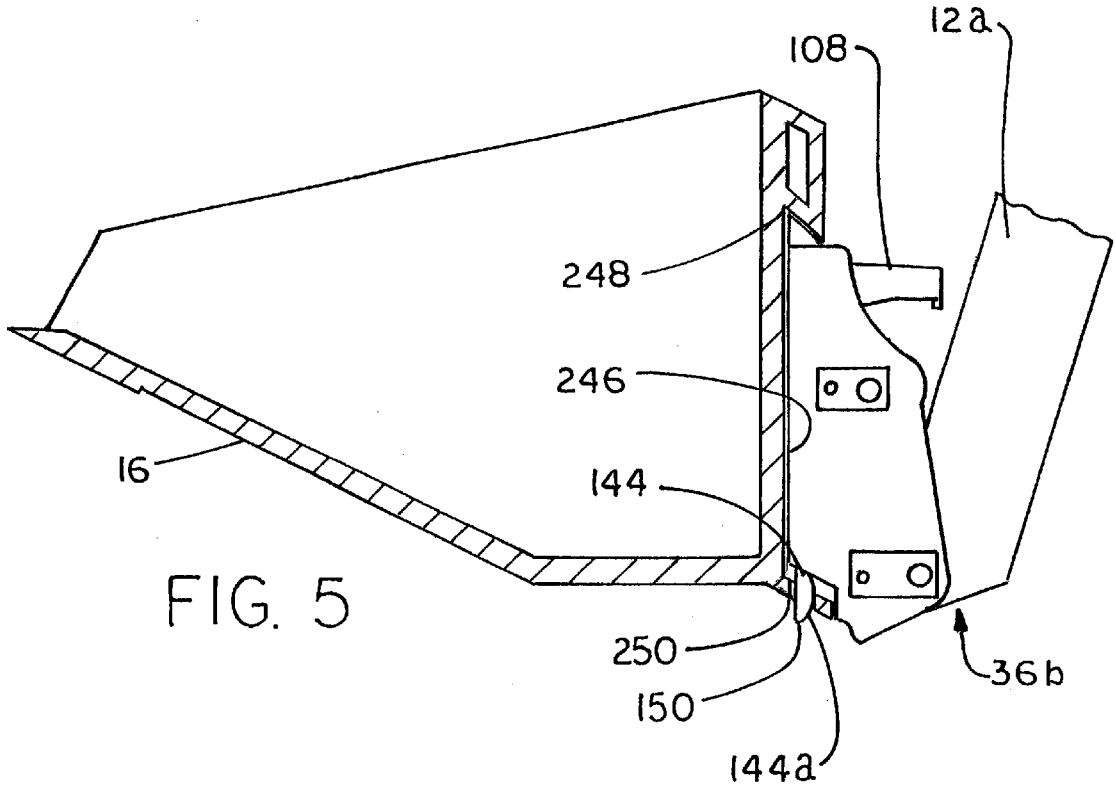
FIG. 5 is a cross-sectional view showing the coupling device of the present invention with the coupling pins in the extended position in order to interconnect the loader arms of the skid steer to an attachment tool.
Figure 6:
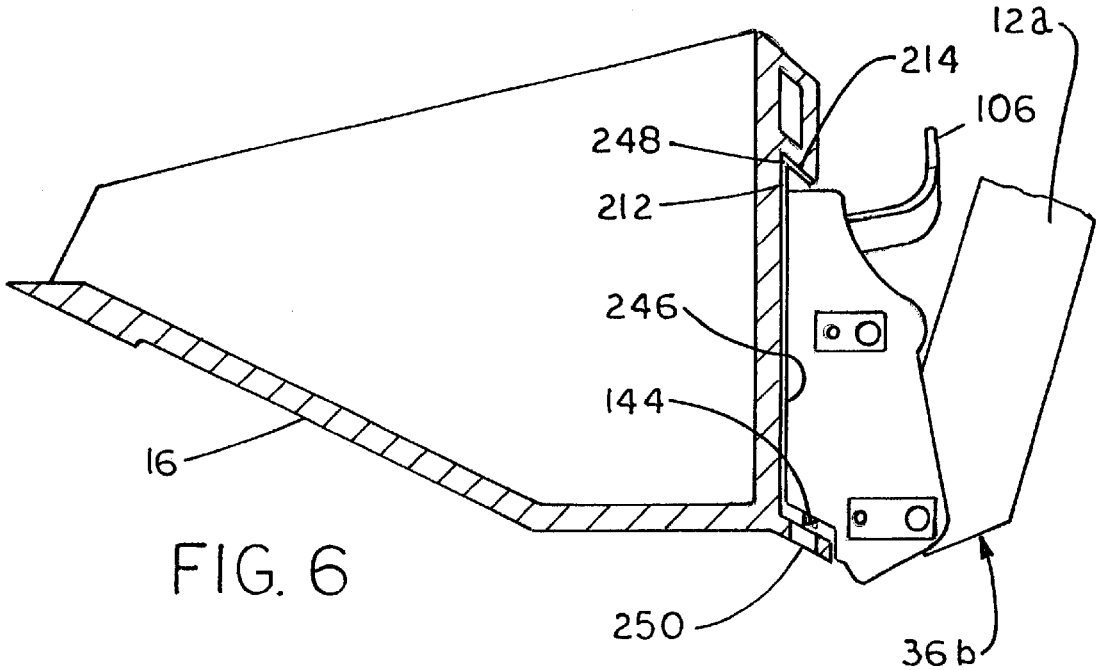
FIG. 6 is a cross-sectional view, similar to FIG. 5, showing the coupling device of the present invention with the coupling pins in the retracted position in order to disengage the loader arms of the skid steer from the attachment tool.

Referring to FIGS. 4–5, in order to interconnect bucket 16 to skid steer 14, handles 106 and 108 of coupling device 10 are pivoted to the pin retracted position, FIGS. 3 and 6, as heretofore described. Coupling device 10 is aligned with the rearward surface of bucket 16 such that the resilient connector formed by legs 212 and 214 of upper support bracket 200 is positioned within a corresponding receiving cavity 248 formed in the rearward surface 246 of bucket 16 and such that the resilient connector formed by legs 230 and 232 of support bracket 202 is positioned within a corresponding second leg support cavity (not shown) formed in the rearward surface of bucket 16. In addition, end surfaces 150 and 184 of coupling pins 144 and 178, respectively, are axially aligned with corresponding pin-receiving apertures 250 formed in the rearward surface 246 of bucket 16.

Handles 106 and 108 are pivoted to the pin extended position, FIGS. 4–5, such that end surfaces 150 and 184 of pins 144 and 178, respectively, extend through corresponding pin-receiving apertures 250 formed in the rearward surface 246 of bucket 16. Tapered surfaces 152 and 186 of coupling pins 144 and 178, respectively, compensate for variances in the distance between pinreceiving apertures 250 in the rearward surface 246 of bucket 16. With handles 106 and 108 in the coupling pin extended position, FIGS. 4 and 5, bucket 16 is interconnected to skid steer 14 and ready for use.

In order to disconnect bucket 16 from skid steer 14, handles 106 and 108 are pivoted, as heretofore described, to the pin retracted position, FIGS. 3 and 6, such that coupling pins 144 and 178 are removed from corresponding pin-receiving apertures 250 in the rearward surface 246 of bucket 16. The resilient connector formed by legs 212 and 214 of support bracket 200 is removed from the corresponding second leg receiving cavity formed in the rearward surface 246 of bucket 16 and the resilient connector formed by legs 230 and 232 of support bracket 202 is removed from the corresponding leg receiving cavity (now shown) formed in the rearward surface 246 of bucket 16, thereby disengaging bucket 16 from skid steer 14.

It can be appreciated from the above description of the various alternate attachment tools may be quickly and securely mounted on a skid steer utilizing the coupling device of the present invention.

In addition, various modes of carrying out the invention are contemplated as being within the scope of the following claims particularly pointing out and distinctly claiming the subject matter regarded as the invention.

I claim:

1. A coupling device for interconnecting an attachment tool to loader arms of a skid steer, comprising:

a frame extending along an axis and mountable on the loader arms of the skid steer;

a handle mounted to the frame, the handle movable between a first unlocking position and a second location position;

a first coupling pin operatively connected to the first handle at an angle to the axis and movable along a first pin axis between a first retracted position and a second extended position in response to movement of the first handle between the unlocking position and the locking position;

a second handle mounted to the frame, the second handle movable between a first unlocking position and a second locking position;

a second coupling pin operatively connected to the second handle and movable along a second pin axis between a first retracted position and a second extended position in response to movement of the second handle between the unlocking position and the locking position; and wherein the first and second pin axis diverge from each other at a predetermined angle greater than zero degrees.

2. The coupling device of claim 1 further comprising a support bracket interconnected to the frame for supporting an upper portion of the attachment tool.

3. The coupling device of claim 2 further comprising a second support bracket laterally spaced from the first support bracket for supporting an upper portion of the attachment tool.

4. The coupling device of claim 1 further comprising a shroud interconnected to the frame and partially surrounding the insert coupling pin.

5. The coupling device of claim 1 wherein the frame includes first and second connection elements defining a loader arm receipt cavity, the loader arm receipt cavity receiving an end of a corresponding loader arm.

6. The coupling device of claim 5 further comprising a connection pin extending through the support elements and the end of the corresponding loader arm to pivotally interconnect the frame to the corresponding loader arm.

7. The coupling device of claim 1 wherein the first coupling pin includes a tapered end.

8. A coupling device for interconnecting a loader arm of a skid steer to an attachment tool having a mounting bracket and having first and second apertures in a rearward surface thereof extending therethrough, comprising:

a frame extending along an axis and pivotally connectable to an end of the loader arm, the frame having first and second opposite sides;

a support bracket mounted to the first side of the frame for engaging the mounting bracket of the attachment tool;

a first pin slidably supported by the frame at an angle to the axis and having a coupling end, the first pin movable along a first pin axis between a first extended position wherein the coupling end of the first pin is extendable through the first aperture in the rearward surface of the attachment tool and a second retracted position;

a first handle for controlling movement of the first pin between the extended and the retracted positions;

a first locking element for maintaining the first pin in the extended position;

a second pin slidably supported by the frame at an angle to the axis and having a coupling end, the second pin movable along a second pin axis between a first extended position wherein the coupling end of the second pin is extendable through the first aperture in the rearward surface of the attachment tool and a second retracted position;

a second handle for controlling movement of the second pin between the extended and the retracted position;

a second locking element for maintaining the second pin in the extended position; and wherein the first pin axis and the second pin axis diverge from each other at a predetermined angle greater than zero degrees.

9. The coupling device of claim 8 wherein the ends of the pins are tapered.

10. The coupling device of claim 8 wherein the support bracket includes a resilient engagement element for engaging the mounting bracket of the attachment tool.

11. The coupling device of claim 8 further comprising a shroud interconnected to the frame and partially surrounding the first pin.

12. The coupling device of claim 8 wherein the frame includes first and second connection elements defining a loader arm receipt cavity for receiving an end of a corresponding loader arm.

13. The coupling device of claim 12 further comprising a connection pin extendable through the support elements and the end of the corresponding loader arm to pivotally interconnect the frame to the corresponding loader arm.

* * * * *